US008951179B2

(12) United States Patent
Tommasi

(10) Patent No.: US 8,951,179 B2
(45) Date of Patent: Feb. 10, 2015

(54) UNIT AND METHOD FOR FEEDING REELS OF A SHEET-LIKE MATERIAL, IN PARTICULAR BUT NOT EXCLUSIVELY A PRINTED PLASTIC FILM WITH PRINT-POSITION MARKS FOR AUTOMATIC PACKAGING MACHINES

(75) Inventor: Renzo Tommasi, Montecatini Terme (IT)

(73) Assignee: Rent S.r.l., Massa e Cozzile (Pistoia) (IT)

( * ) Notice: Subject to any disclaimer, the term of this patent is extended or adjusted under 35 U.S.C. 154(b) by 733 days.

(21) Appl. No.: 13/266,665

(22) PCT Filed: Apr. 30, 2010

(86) PCT No.: PCT/IB2010/051910

§ 371 (c)(1),
(2), (4) Date: Jan. 10, 2012

(87) PCT Pub. No.: WO2010/128441

PCT Pub. Date: Nov. 11, 2010

(65) Prior Publication Data

US 2012/0100978 A1 Apr. 26, 2012

(30) Foreign Application Priority Data

May 5, 2009 (IT) ..... FI2009A0091

(51) Int. Cl.
*B31B 1/64* (2006.01)
*B65H 19/18* (2006.01)
(Continued)

(52) U.S. Cl.
CPC ..... *B65H 19/1836* (2013.01); *B65H 23/1882* (2013.01); *B65H 2301/4621* (2013.01);
(Continued)

(58) Field of Classification Search
CPC .... B65H 19/18; B65H 19/1842; B65H 19/20; B65H 21/00; B65H 69/08; B32B 37/00
USPC ..... 156/157, 502, 159; 493/227
See application file for complete search history.

(56) References Cited

U.S. PATENT DOCUMENTS 3,440,126 A * 4/1969 Robinson et al. ..... 156/505
4,157,934 A * 6/1979 Ryan et al. ..... 156/504
(Continued)

FOREIGN PATENT DOCUMENTS

DE 198 00 278 A1 11/1998
DE 197 48 614 A1 5/1999
(Continued)

*Primary Examiner* — Gloria R Weeks
(74) *Attorney, Agent, or Firm* — Lucas & Mercanti, LLP

(57) ABSTRACT

A feeding unit from reels of sheet-like material , in particular but not exclusively printed plastic film with print-position marks for automatic packaging machines, comprising two unrolling shafts of respective reels of material for feeding in turn said material towards a unit that cuts and welds the tail of material of a running out reel and the head of a fresh, loaded reel. Such a unit comprising suction, cutting and welding devices (7, 8) movable so as to approach and move away from each other to press the material (F1, F2) over a welding plane. Each device is formed by a group of mutually stacked suction and cutting modules, at least two of such modules having respective guides for slidable in a transversal direction with the respect to the feeding direction of the material, whereby it is possible to select and adjust the number of modules according to a desired welding height.

14 Claims, 7 Drawing Sheets

(51) Int. Cl.
*B65H 19/20* (2006.01)
*B65H 23/188* (2006.01)

(52) U.S. Cl.
CPC ..... *B65H2301/4634* (2013.01); *B65H 2301/46412* (2013.01); *B65H 2406/351* (2013.01); *B65H 2511/142* (2013.01); *B65H 2553/41* (2013.01)
USPC ..... 493/203; 493/227; 156/159; 156/502

(56) References Cited

U.S. PATENT DOCUMENTS 4,190,483 A * 2/1980 Ryan et al. ..... 156/504
4,744,845 A * 5/1988 Posey ..... 156/159
5,049,117 A * 9/1991 Mueller ..... 493/188
5,064,488 A 11/1991 Dickey
5,300,166 A 4/1994 Aihara
5,388,387 A * 2/1995 McElvy ..... 53/451
5,411,223 A * 5/1995 Gatteschi ..... 242/551
5,468,321 A * 11/1995 van Liempt et al. ..... 156/159
5,902,448 A * 5/1999 Stettner ..... 156/510
6,161,793 A 12/2000 Lindstrand
6,500,288 B2 * 12/2002 Hara et al. ..... 156/159
6,578,616 B2 * 6/2003 Stein et al. ..... 156/504
6,858,105 B2 * 2/2005 Hartman et al. ..... 156/159
6,941,994 B2 * 9/2005 Kushihashi et al. ..... 156/505
7,708,043 B2 * 5/2010 Pasqualoni ..... 156/502
7,803,242 B2 * 9/2010 Hagman et al. ..... 156/159
7,938,925 B2 * 5/2011 Cummings et al. ..... 156/157
7,960,002 B2 * 6/2011 Futase ..... 428/57
7,981,246 B2 * 7/2011 Trinks et al. ..... 156/502
8,002,924 B2 * 8/2011 Machamer ..... 156/159
8,142,585 B2 * 3/2012 Aoshima ..... 156/73.4
8,281,839 B2 * 10/2012 Futase ..... 156/502
8,381,787 B2 * 2/2013 Elsperger ..... 156/502
8,563,381 B2 * 10/2013 Hsieh ..... 438/270
2002/0059982 A1 * 5/2002 Hartman et al. ..... 156/506
2004/0084561 A1 5/2004 Clifford

FOREIGN PATENT DOCUMENTS

FR 2 815 952 A 5/2002
GB 2 260 532 A 4/1993

* cited by examiner

UNIT AND METHOD FOR FEEDING REELS OF A SHEET-LIKE MATERIAL, IN PARTICULAR BUT NOT EXCLUSIVELY A PRINTED PLASTIC FILM WITH PRINT-POSITION MARKS FOR AUTOMATIC PACKAGING MACHINES

CROSS-REFERENCE TO RELATED APPLICATIONS

This application is a 371 of PCT/IB2010/051910, filed Apr. 30, 2010, which claims the benefit of Italian Patent Application No. FI2009A000091, filed May 5, 2009, the contents of each of which are incorporated herein by reference.

FIELD OF THE INVENTION

The present invention concerns the field of packaging apparatuses, and in particular that of high-speed machines and systems for packaging products such as tissues, serviettes or other similar paper products with printed plastic film (polypropylene, polyethylene, PVC etc.).

BACKGROUND OF THE INVENTION

In such machines and systems, a film is used in which a reference mark has previously been applied, which is used to help the printed figures/inscriptions to be precisely positioned, and to be read automatically by the packaging apparatuses, in the step in which the film itself is wrapped around the material to complete its packaging.

The feeding of the film to the packaging unit is carried out by a feeding unit provided with two reels for unwinding the material, one of which is alternately at work while on the other the run-out reel is replaced with a new loaded reel, which waits for the reel being unwound to run out. There is thus the problem of joining the tail of the running out material with the head of the new loaded reel, with the latter finally replacing the other as the active reel.

The systems currently known for automatically controlling this so-called "reel change" step are unsatisfactory in speed and reliability, indeed often resulting in stops in production that in turn lead to wastage of product due to problems of centering the printing on the package, welding defects, defective packaging as a result of variations in speed of the film etc.

SUMMARY OF THE INVENTION

The object of the present invention is to provide a feeding unit for packaging apparatuses generically of the above mentioned type, which is capable to carry out a reel change that is totally reliable and without involving any substantial speed limitation to the feeding of the material, all with relatively simple constructive solutions.

According to the invention, such an object is achieved with a unit and method for feeding reels of sheet-like material, in particular but not exclusively printed plastic film with print-position marks for packaging machines the essential characteristics of which are defined, respectively, by the attached claims 1 and 15.

BRIEF DESCRIPTION OF THE DRAWINGS

The characteristics and advantages of the unit and method for feeding reels of sheet-like material, in particular but not exclusively printed plastic film with print-position marks for packaging machines according to the present invention will become apparent from the following description of an embodiment thereof, given as a non-limiting example, with reference to the attached drawings, in which.

DESCRIPTION OF AN EMBODIMENT

Figure 1:
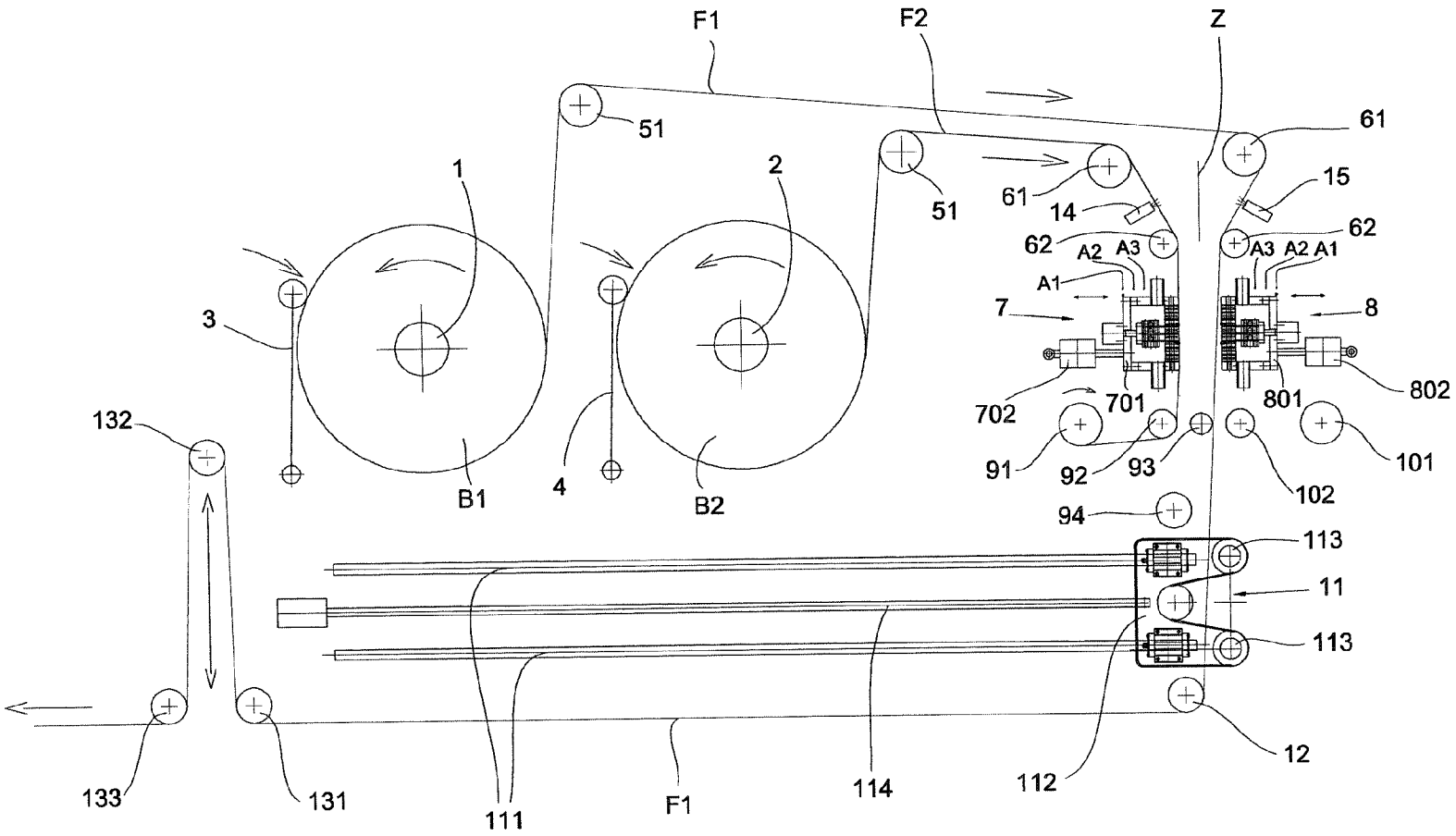
FIG. 1 is a schematic view of a feeding unit according to the invention, sectioned on a median plane perpendicular to the unwinding axes of the reels.

With reference to the above figures, and in particular to FIG. 1, a feeding unit according to the invention, positioned upstream of a conventional packaging unit that has not been represented, comprises two side-by-side motorized shafts 1, 2 for unwinding respective reels B1 and B2. Devices for detecting the diameter of the reels (and therefore the amount of material unwound and still to be unwound), schematically represented and indicated with 3 and 4, are associated with the reels themselves and have structural and, as such, known functional characteristics.

Figure 9:
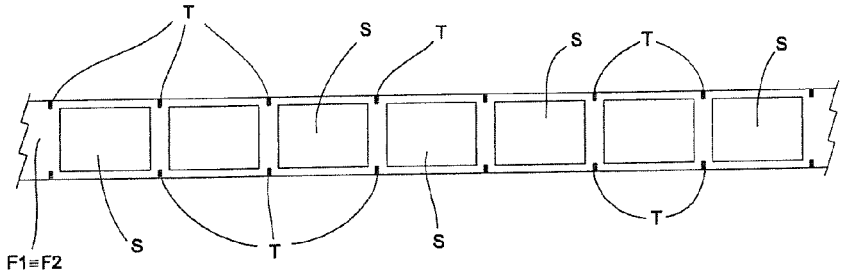
FIG. 9 is a plan view from above of a piece of sheet-like material fed by the unit according to the invention.

The sheet-like material or film unwound from the reels, respectively indicated with F1 and F2, engages with respective return rolls 51, 61, 62, arranged above and alongside the shafts 1 and 2, so as to feed the material itself, from above, into a cutting and welding area comprising a pair of suction, cutting and welding devices generally indicated with 7 and 8, respectively. Between the rolls 61 and 62 there are respective photocell sensors 14 and 15, adapted to detect the passage of reference marks T (FIG. 9) printed on the material F1 and F2 indeed as a position reference of the printed regions S of the same material.

The two devices 7 and 8 are arranged symmetrically with respect to a vertical coupling plane Z of the material, and they are horizontally movable so as to approach or move away from each other, as will be discussed in greater detail hereafter. The material F1 and/or F2 descends vertically between the two devices 7 and 8, and runs downwards where, downstream of groups of tensioning rolls 91, 92, 101, 102, separated by deviating rolls 93, 94, it reaches an accumulation device 11, also described in greater detail hereafter, to finally be deviated horizontally by a roll 12 and exit downstream of a group of tensioning rolls 131, 132, 133. Between the latter, an intermediate roll 132 is adapted to translate vertically to act indeed as a means for adjusting the tension of the material. Such rolls, just like all those mentioned above, obviously have their rotation axis parallel to that of the two unwinding shafts 1, 2.

Figure 11:
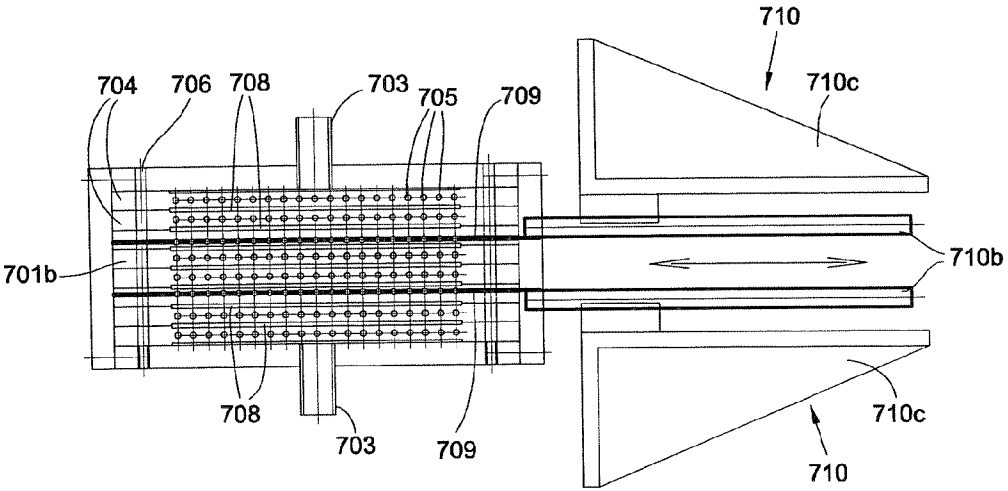
FIGS. 10 and 11 respectively show a schematic side section view like in FIG. 1, and a front view (i.e. in a direction perpendicular to the sliding plane of the material being fed) with parts schematically sectioned, of a suction, cutting and welding device according to the invention.
Figure 12:
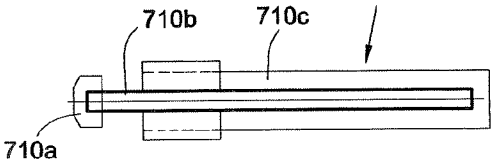
FIG. 12 represents an isolated view, seen in plan from above, of a lower cutting device of the device according to FIGS. 10 and 11.
Figure 10:
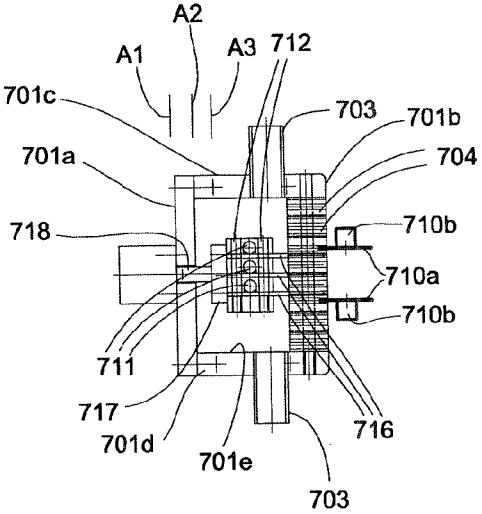
Figure 22:
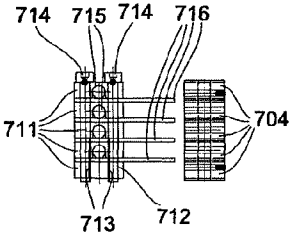
FIGS. 20 to 22 are schematic side views, respectively, of the combinations of modules of FIGS. 17 to 19, also with corresponding combinations of welding modules of the device represented.
Figure 21:
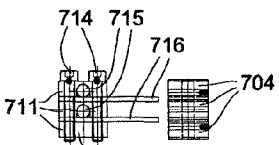
Figure 20:
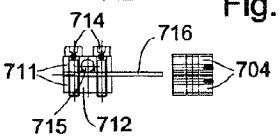
Figure 19:
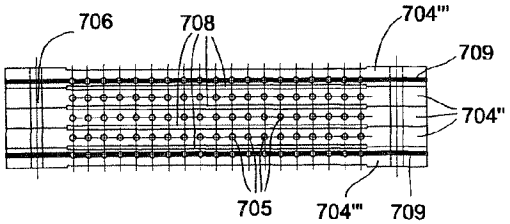
FIGS. 17 to 19 show front view of various respective possible combinations of modules according to FIGS. 13 to 16.
Figure 18:
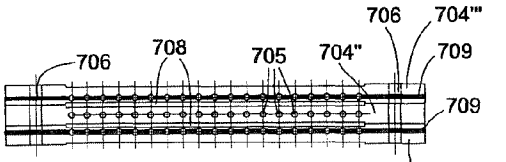
Figure 17:
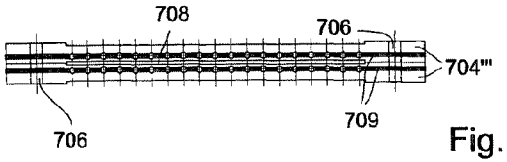
Figure 13:
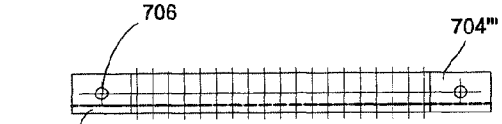
FIGS. 13 and 14, respectively, are a view from above and a front view of a suction and cutting module of the device of FIGS. 10 and 11.
Figure 14:
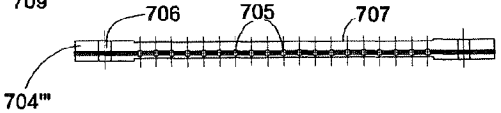
Figure 15:
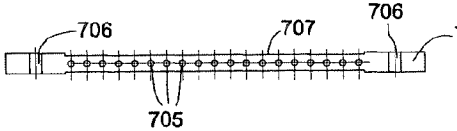
FIGS. 15 and 16 show front views of respective further modules of the device.
Figure 16:
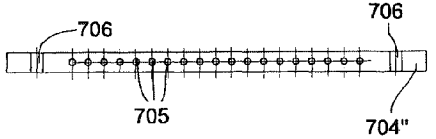

Going back in particular to the devices 7 and 8, one of them, in particular the one on the left 7 with respect to the view of FIG. 1, is partially represented with greater clarity in FIGS. 10 to 12, as well as in FIGS. 13 to 22 in terms of the modules of which it is made up, in possible combinations. Hereafter reference will be made only to the device 7; the other device 8 is identical, apart from what will be specified later on, and therefore will not be described, taking into account that the relative components in the drawings are indicated with reference numerals that correspond to those used for the device 7.

The device 7 comprises a box-like body 701, with a parallelepiped shape, mobile in a reciprocating manner in the horizontal direction driven by linear actuator means such as a pneumatic cylinder 702 (FIG. 1, not represented in FIG. 10). In particular, the body 701 is mobile in a reciprocating manner between three positions, indicated in the figures by three references A1, A2, A3 with which, respectively in each position, a rear vertical wall 701*a* of the body is aligned. More specifically, in a maximum frontward displacement A3 the front vertical wall 701*b* parallel and opposite to the aforementioned rear wall 701*a* lies on the coupling plane Z. There are then an intermediate position A2 and a maximum rearwards displacement position A1. The maximum frontward position A3 corresponds to the welding position, the intermediate position A2 corresponds to a cutting position, and the maximum rearwards displacement A1 is a rest condition.

The upper and lower walls 701*c*, 701*d* of the body 701 have channels 703 running over them that put the inside of the body 701 in communication with the outside. Such channels 703 are junctions for a pneumatic suction system, adapted to generate a depression in the chamber 701*e* defined internally by the body 701.

The front vertical wall 701*b* faces towards the other device 8 and thus onto the area for the passage of the material F1/F2, and it is formed by composition or, more precisely, stacking, of single suction and cutting modules 704 (FIGS. 12 to 15). Each of said modules 704 in practice consists of a profile with a quadrangular section in which distributions of holes 705 are formed passing between the front face, defining the front vertical wall 701*b*, and the face parallel and opposite. Through the holes 705, thanks to the aforementioned pneumatic depression, a suction is produced that is able to attract and block the material F1/F2. At the two ends of the profile there are seats 706, perpendicular to the holes 705, for the insertion of bolt elements adapted to lock various stacked modules 704 to one another and to the remaining portions of the body 701.

Moreover, it can be seen, in particular from FIGS. 13 to 16, that the module 704 can be configured in substantially three variants, and in particular (FIG. 16): a first variant 704' in which the profile is a simple bar with a full quadrangular section; a second variant 704" in which the upper and lower faces of the profile are extensively provided with a cavity 707, for which reason two stacked modules define a slit 708 running practically along the entire width of the device (seen frontally like for example in FIG. 11); and a third variant 704''', analogous to the second variant 704" but with a supplemental groove 709 formed longitudinally in the front face, and acting as a guide for the sliding of a blade 710*a*.

The blades 710*a*, forming part of respective cutting devices generally indicated with 710 and shown as a whole only in FIGS. 11 and 12, as shall be seen hereafter are intended for cutting the material F1/F2. In each device 710 such blades are fixed (FIG. 12) to the ends of bar-shaped sliders 710*b*, slidingly mounted so as to slide in the horizontal direction on respective supports 710*c*. The height of the bar-shaped sliders 710*b* is adjustable through vertical displacement of the supports 710*c*. The devices 710 are clearly arranged alongside the body 701 so that the blades 710*a* are adapted to superimpose with the front of the wall 701*a* sliding transversally in the grooves 709. The operation of each blade 710 is controlled by systems with obvious configuration (for example a pneumatic actuator), and the blade can be heated through electrical resistances, in order to assist the cutting.

Housed in the chamber 701*e* of the box-like body 1 there is (see in particular FIG. 10) a stacked group of welding modules 711, each in turn formed from a bar-like profile 712 with seats 713 at the ends for the insertion of lock bolts 714. Each profile 712, with the exception of the one at the lower end, is provided at the base with a longitudinal channel along which electrical resistance heating elements 715 are arranged. Such elements transmit the heat to welding plates 716, lying horizontally and clamped between one profile and the profile below, and projecting frontally so as to slidingly penetrate, in the welding step, the aforementioned slits 708, thus reaching the outside of the device on the front vertical wall 701*b*. The group of welding modules 711 is, to this purpose, supported by a support 717 moved with reciprocating motion, by pneumatic actuators 718 arranged in parallel, with respect to the rear wall 701*a* of the body 701.

Considering FIGS. 17 to 22, it can be seen how the various suction, cutting and welding modules can be combined so as to adjust the positioning of the cutting lines, in particular by increasing (FIGS. 19 and 22) or decreasing (FIGS. 17 and 20) the height difference between the two cutting lines (grooves 709) necessary to carry out the reel change operations, described hereafter. Consequently, the number of welding modules 711 will increase or decrease, the plates 716 of which must occupy all of the slits 708 in the space comprised between the two cutting lines. In practice, such possibilities of adjustment are used to increase or decrease the longitudinal extension (the reference is to the longitudinal direction of the material F1/F2) of the weld.

Considering now the accumulation device 11, it comprises a system of guides 111, which extend horizontally along the outlet plane of the material towards the packaging unit, and in parallel therewith, all—as mentioned—downstream of the suction, cutting and welding devices 7, 8, and upstream of the group of tensioning rolls 131, 132, 133. The guides 111 slidingly support a carriage 112 with a pair of idle rolls 113 adapted to engage with the material F1/F2 and, following the horizontal displacement of the carriage approaching the outlet area, to increase the path along which the material itself must run.

An actuator 114 drives the carriage 112, also in this case preferably of the pneumatic type and arranged between the guides 111. The carriage 112, in normal working conditions of the unit (i.e. outside of the reel change step), stays in a forward end stop position substantially vertically aligned with the cutting and welding area, without interfering with the passing material.

The system of the pneumatic and electrical circuits (for power and control, including a programmable control unit) generally suitable for managing the operation of the unit is neither represented or described, hence it complies with design criteria that are obvious as such, based on the functions to be performed, for any man skilled in the art.

With reference in particular to FIGS. 1 to 8, the feeding unit according to the invention works in the following manner. FIG. 1 represents a starting situation in which the material F1 is unwinding at the work speed from the reel B1 on the shaft 1 to be fed to the packaging unit, and to this purpose it does not interfere either with the devices 7, 8 (both in the maximum rearwards displacement A1), or with the accumulation device 11. A new loaded reel B2 is ready and available on the other shaft 2, the head of the material F2 having been unwound and prepared with the passage between the two devices 7, 8, the engagement by suction with the device 7 and, downstream of it, with the tensioning rolls 91, 92. The latter indeed keep the material stretched, the material being moved forward at a controlled speed up to a stop determined precisely as a function of the reading, on the material, of a print position mark T, by the photocell reader 14.

Figure 2:
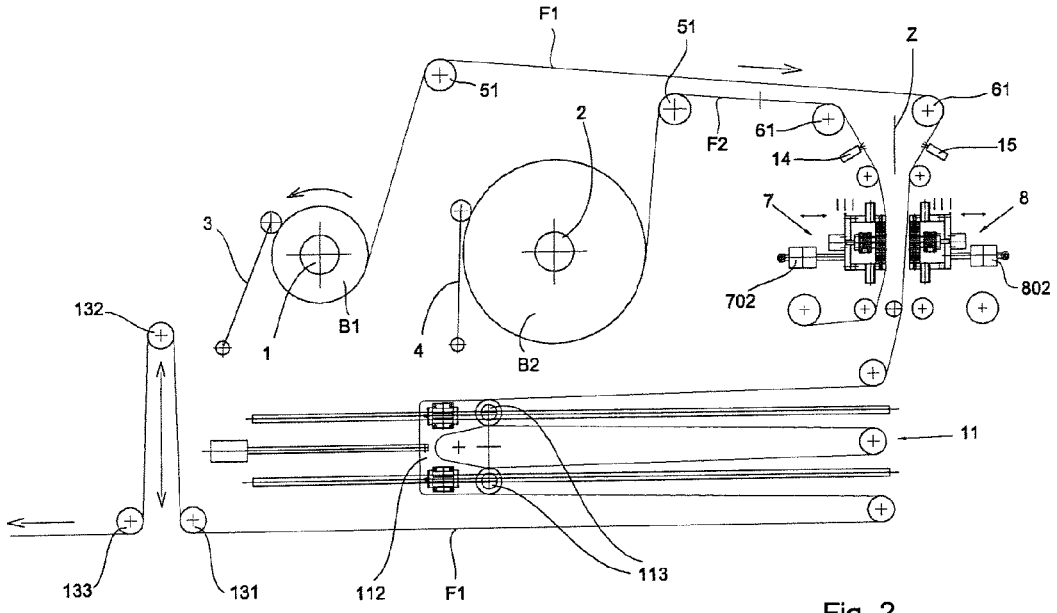
FIGS. 2 to 8 show the unit similarly to FIG. 1, in respective successive steps of the reel change procedure.
Figure 3:
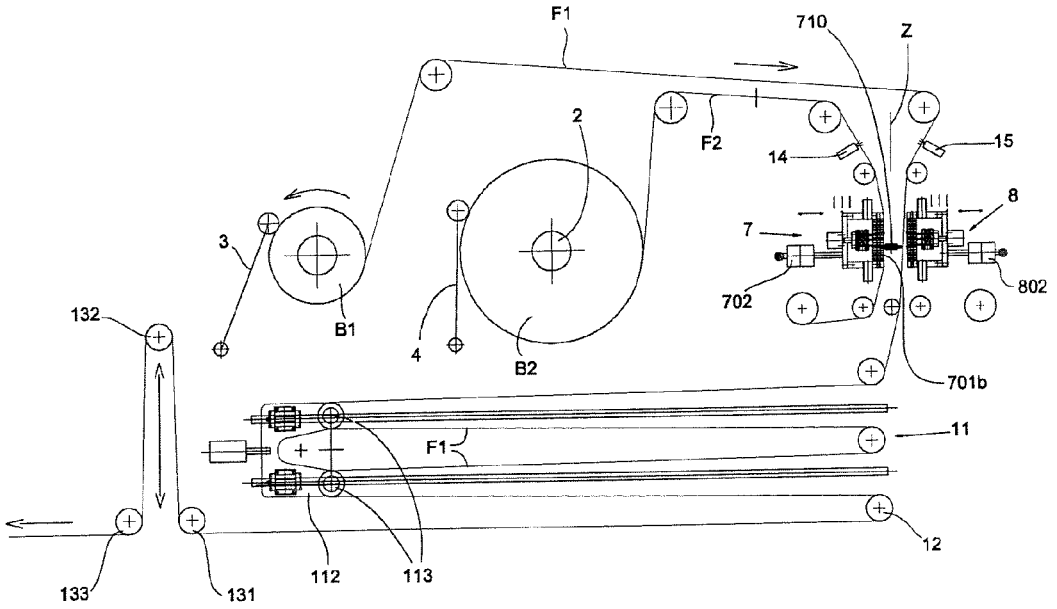
Figure 4:
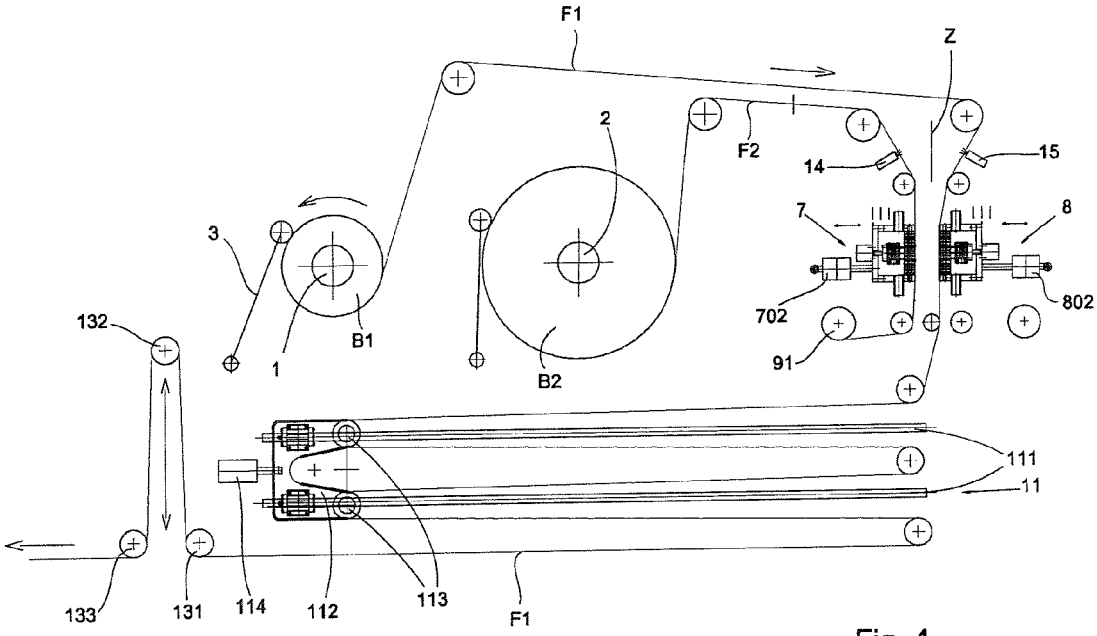

In FIG. 2 shows the reel B1 is running out. In order to prepare the reel change step, the imminence of which is indicated by the detection device 3, and foreseeing the stopping of the shaft 1, the carriage 112 hooks onto the material F1 and moves towards the opposite end stop position (FIG. 3), so as to create a substantial accumulation along the increased path deriving from the deviation. The device 7, holding onto the stopped material F2 (the shaft 2 is in this step stopped), moves forward into the intermediate or cutting position A2. In FIG. 3 it can also be seen how the relative lower blade 710 has begun to operate to cut the material, sliding in a reciprocating manner in the relative groove 709 on the front wall 701*b* of the body 701, and then going back into rest position.

Figure 5:
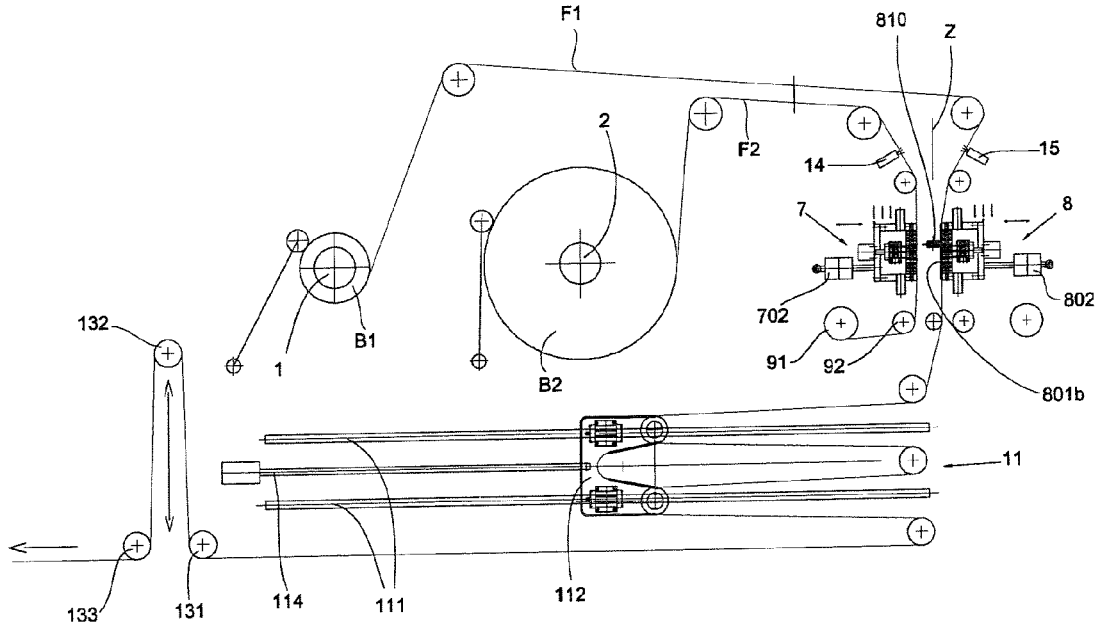

The device 7 then in turn goes back into its rest or maximum rearward displacement position (FIG. 4) A1. The shaft 1 with the reel B1 continues to feed the material F1 at the work speed, with the device 8 that now holds onto such a material awaiting the cutting (again FIG. 4), taking up the cutting position A2. When the detection device 3 indicates that the end of the reel B1 has now been reached, the shaft 1 stops and the upper blade 810 starts to operate on the device 8, carrying out the cutting of the material F1 (FIG. 5). Also in this case, thanks to the reading by the photocell reader 15, the stopping and cutting are perfectly calibrated on a print position mark. Again FIG. 5 and the subsequent FIG. 6 show how the carriage 112 of the accumulation device 11, returning towards the frontward end stop position, "supplies back" the material F1 previously collected, not stopping the feeding downstream which, in practice, is not interrupted.

Figure 6:
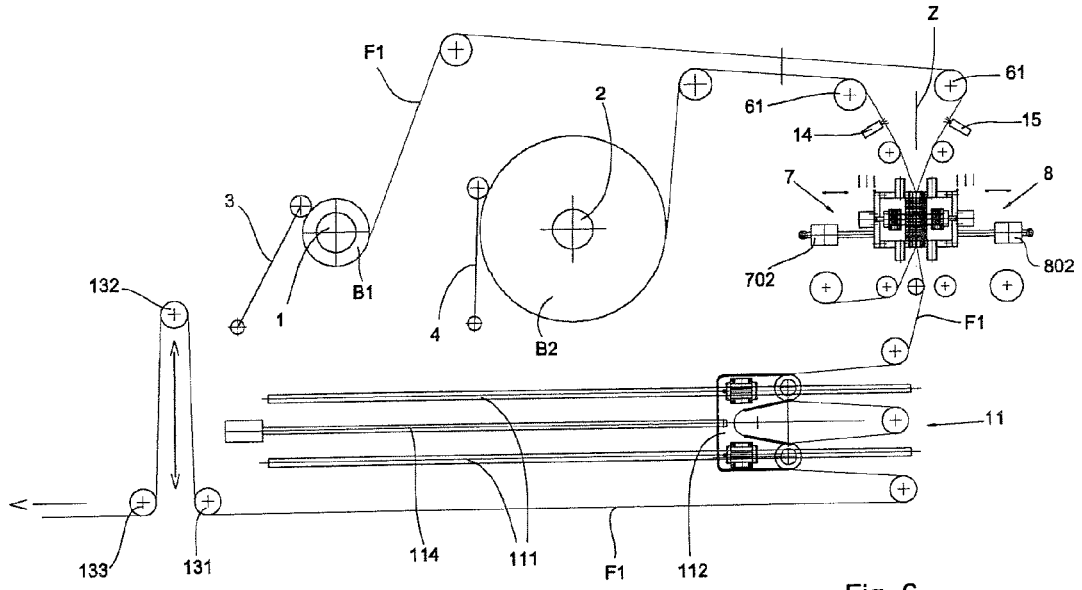
Figure 7:
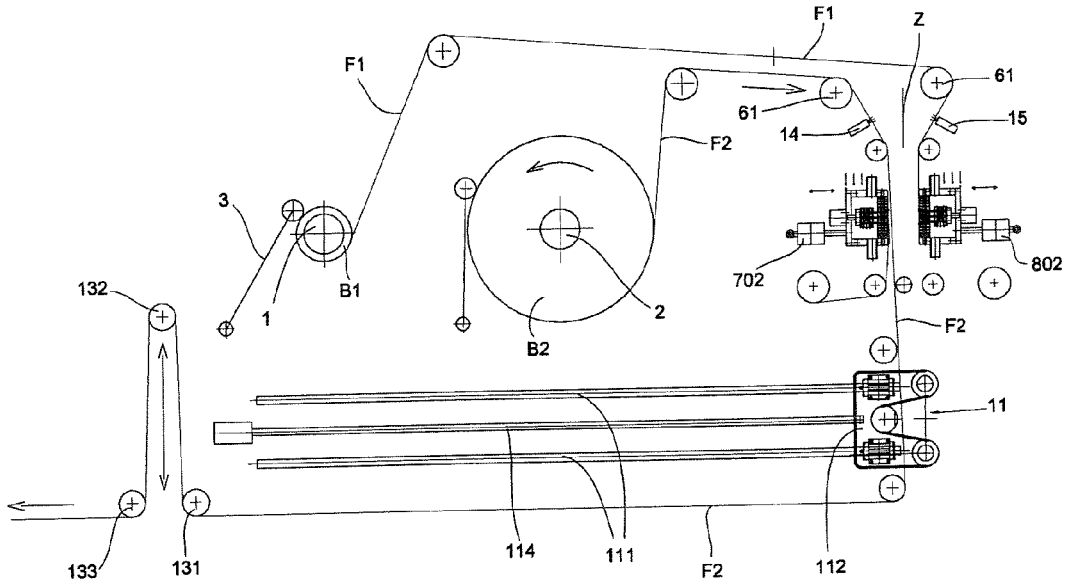

Still considering FIG. 6, the two devices 7 and 8 can at this point both move forward towards the position of maximum frontward displacement or welding position A3. The head of the material F2 and the tail of the material F1, engaged by suction and compressed between the two front walls 701*b* and 801*b* on the plane Z, overlap. The welding blades 716, until then in a rearward displaced arrangement, move forward driven by the actuators 718 and, reaching the outside of the body through the slits 708, operate on the material carrying out the welding for a section corresponding to the distance between the two cuts, in turn determined by the (adjustable) position of the blades.

Figure 8:
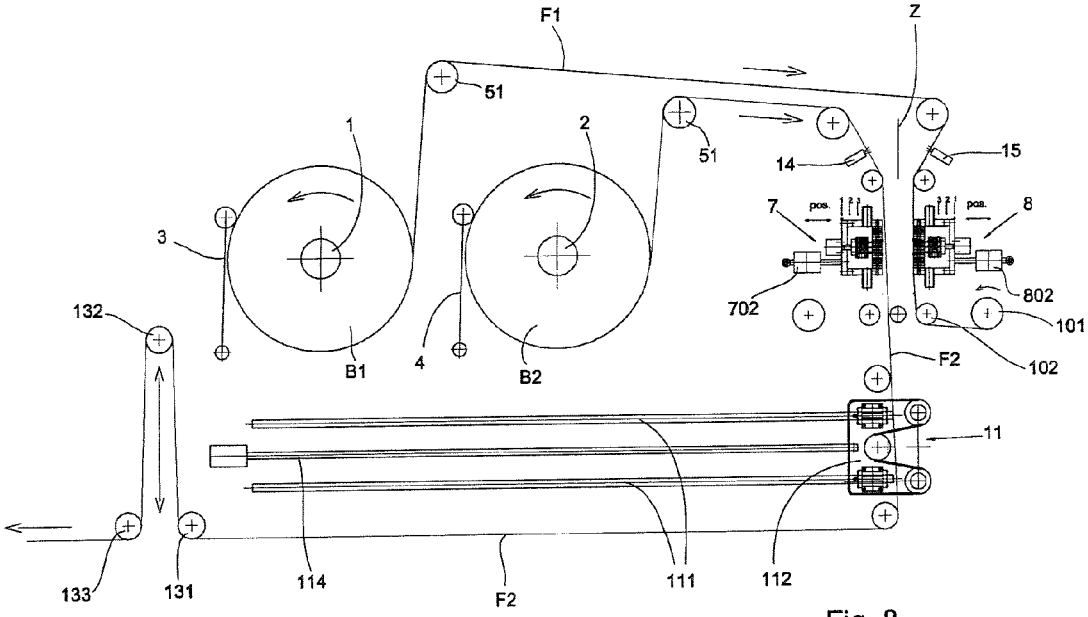

Once the welding has been carried out (FIG. 7) the shaft 2 can start up again. With the suction action of the two devices 7 and 8 having been removed, and therefore the material having been freed, the same devices go back into the maximum rearwards displacement A1 (with the blades 716 that in turn go back into the body 701). The carriage 112 of the collection device once again gains the frontward end stop position, ending the release of accumulated material. In practice the normal work condition is reset, in this case with feeding of the material F2 unwinding from the reel B2 on the shaft 2. Finally, FIG. 8 represents a situation which is totally the same, though mirrored, as the original one of FIG. 1, with a new loaded reel B1 that has been replaced on the shaft 1 in place of the run out one, whereas the feeding by the shaft 2 continues undisturbed. The subsequent reel change step will exactly follow, although inverted, the same operations just described.

From what has just been described it is clear how the system according to the invention achieves the result of keeping the absolute continuity and regularity of the fed material, since the cutting operations are carried out with the maximum precision taking the print position marks applied to the material as its own reference. The printed areas will therefore maintain totally correct spacing even between the head and the tail of material welded together.

The length of the welding area can be varied substantially at will thanks to the modularity of the cutting and welding devices, and the feeding speed (and therefore the production speed) is never reduced, thanks to the accumulation system the capacity of which must clearly be adjusted in a suitable manner (higher production speeds requiring greater accumulation capacities). It is worth emphasising the important role of the groups of tensioning rolls 91, 92, 101, 102, which by engaging with the head of material of the loaded reels keep it in the stretched condition suitable for allowing the devices 7, 8 to operate with the maximum accuracy. Said group of tensioning rolls 91, 92, 101, 10, adapted to engage with the head of the material of the loaded reels to keep it stretched on the respective devices, and the operation of the same rolls, are technically independent from the features of the suction, cutting and welding devices 7, 8 and can therefore, according to an aspect of the invention, be advantageously used also in an apparatus lacking of the characterizing elements in the attached main claim.

In this way, with relatively basic constructive solutions, the packaging lines can work continuously, with a substantial increase in efficiency, and absence of product waste caused by machine down time.

In terms of the configuration of the devices 7 and 8, it is clear that the width of the welding plates and the stroke of the cutting blades can be varied according to the width of the material being treated. More generally, the devices can undergo numerous adaptations, like for example the absence of the welding modules in one of the two devices, should it be sufficient for the welding to be carried out on just one side. The control of the system can also occur without reading the print position mark, and therefore assisted only by suitable adjustments of the devices for detecting the diameter of the reels.

The vertical/horizontal space references used above are clearly in relation to the most typical operative configuration, and to the orientation represented in the figures, but it is clear that they do not have to be interpreted as limiting.

The present invention has been described up to now with reference to a preferred embodiment. It should be understood that there can be other embodiments falling within the scope of the invention, as defined by the attached claims.

The invention claimed is:

1. A feeding unit for reels of sheet-like material, with print-position marks, for automatic packaging machines, the feeding unit comprising: two unrolling shafts that each support a reel of said material and feed said material towards means for cutting and welding the tail of material from a first one of said reels of said shafts with a head of material from a second one of said reels on the other of said shaft, the unit further comprising a control system of operation of said shafts and said cutting and welding means, wherein said cutting and welding means comprises two suction, cutting and welding devices arranged on mutually opposed sides of a material welding plane, said devices being movable so as to approach and move away from each other, so as to press said head and tail of said materials, and each of said devices comprising a box-like structure including a front wall facing said welding plane, and is defined by a group of mutually stacked suction and cutting modules which define a front wall facing said welding plane, at least two of said modules being provided with respective guides for cutting means slidable in a transversal direction with the respect to the feeding direction of the material, whereby it is possible to choose said modules and adjusting their number according to a desired welding height.

2. The unit according to claim 1, wherein said suction and cutting modules each comprise a profile having a substantially quadrangular section with at the ends engagement seatings for bolt elements and, between two opposite faces, a distribution of through holes adapted to perform a suction on said material as a result of a depression produced within said box-like structure.

3. The unit according to claim 2, wherein said box-like structure comprises channels connected with a suction system, adapted to produce said depression.

4. The unit according to claim 2, wherein said devices are associated to drive means adapted to cause a translation between a position of maximum frontward displacement or welding position (A3), in which said front wall substantially lies over said welding plane (Z), an intermediate or cutting position (A2), and a position of maximum rearwards displacement or rest position (A1), said control system being adapted to have said depression carried out inside said box-like structure when the device is in said cutting and welding positions in order to keep the material (F1, F2) in adhesion to said front walls.

5. The unit according to claim 1, wherein in at least one of said devices said suction and cutting modules are associated to a group of stacked welding modules, placed inside said box-like structure, each welding module comprising a heated welding plate adapted to be the inserted in a slit formed between two superimposed suction and cutting modules so as to reach out for the outside of said structure on said front wall, the number of said stacked welding modules being such as to extend over a welding area defined by said guides of said cutting means, said stacked welding modules being displaceble in a reciprocating manner inside said box like structure and with respect to it, so as to make said plates slide within their respective slits.

6. The unit according to claim 5, wherein said slit is the result of cavities formed on the faces of mutual contact of said suction and cutting modules.

7. The unit according to claim 5, wherein said welding modules each comprise a profile with a substantially quadrangular transversal section with ends seatings engaged with bolt elements, the module being associated to heating means, said welding plates being held between consecutive profiles and projecting frontward to penetrate said slits.

8. The unit according to claim 1, wherein said control system is adapted to operate in cooperation with a signal obtained from detection means detecting the amount of residual material unrolling from said reels.

9. The unit according to claim 8, wherein said control system comprises photocell sensor means adapted to read said print position marks (T) on said unrolling material (F1, F2) whereby said control system is adapted to synchronize the operation of said shafts and said welding and cutting devices as a function of a reading signal obtained by said sensor means.

10. The unit according to claim 9, wherein said sensor means are arranged immediately upstream of said suction, cutting and welding devices.

11. The unit according to claim 1, wherein downstream of said suction, cutting and welding devices accumulation means are provided for accumulating the material, said means being driven by said control system in a coordinated manner with respect to the operation of said shafts and of said devices, in order to keep the feeding of the material continuous during slowing down and a transitional stop of said shafts.

12. The unit according to claim 11, wherein said accumulation means comprise a carriage with idle rolls adapted to engage with said material (F1, F2) to induce it to follow an increased path following to a translation of the same carriage along guide means, the reverse translation inducing a release of the accumulated material over said increased path.

13. The unit according to claim 1, wherein immediately downstream of said devices, respective groups of tensioning rolls are provided, said rolls being adapted to engage with the head of the material of the fresh, loaded reel in order to keep it in tension on the respective devices.

14. The unit according to claim 1, wherein said cutting means comprise respective cutting devices comprising blades slidable in said guides, said blades being fixed at the ends of bar sliders, slidably mounted in a horizontal direction on respective supports vertically displaceable in order to adjust the height of said plates.

* * * * *